US010716174B2

(12) United States Patent
Matsui et al.

(10) Patent No.: US 10,716,174 B2
(45) Date of Patent: Jul. 14, 2020

(54) HEATING COOKER, METHOD FOR CONTROLLING HEATING COOKER, AND HEATING COOKING SYSTEM

(71) Applicant: Panasonic Intellectual Property Management Co., Ltd., Osaka (JP)

(72) Inventors: Gantetsu Matsui, Kyoto (JP); Hirohisa Imai, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 291 days.

(21) Appl. No.: 15/763,653

(22) PCT Filed: Nov. 18, 2016

(86) PCT No.: PCT/JP2016/004918

§ 371 (c)(1),
(2) Date: Mar. 27, 2018

(87) PCT Pub. No.: WO2017/090244

PCT Pub. Date: Jun. 1, 2017

(65) Prior Publication Data

US 2018/0279425 A1 Sep. 27, 2018

(30) Foreign Application Priority Data

Nov. 27, 2015 (JP) ..... 2015-231284

(51) Int. Cl.
*H05B 6/64* (2006.01)
*H05B 6/68* (2006.01)
*F24C 7/08* (2006.01)

(52) U.S. Cl.
CPC ..... *H05B 6/687* (2013.01); *F24C 7/085* (2013.01); *H05B 6/6435* (2013.01); *H05B 6/6444* (2013.01); *H05B 6/6447* (2013.01)

(58) Field of Classification Search
CPC ..... F24C 7/085; H05B 6/6441; H05B 6/687; H05B 6/6447; H05B 6/6435; H05B 6/6444
(Continued)

(56) References Cited

U.S. PATENT DOCUMENTS

2013/0293735 A1 11/2013 Suzaki
2015/0366219 A1* 12/2015 Stork genannt Wersborg ..... A21B 1/40 702/136
2017/0303348 A1* 10/2017 Kondo ..... H05B 6/6447

FOREIGN PATENT DOCUMENTS

CN 103095987 A 5/2013
JP 3036671 U 5/1997
(Continued)

OTHER PUBLICATIONS

English Translation of Chinese Search Report dated Jan. 3, 2019 for the related Chinese Patent Application No. 201680060747.3.
(Continued)

*Primary Examiner* — Quang T Van
(74) *Attorney, Agent, or Firm* — Brinks Gilson & Lione

(57) ABSTRACT

A heating cooker includes shooting section (201) for shooting an image inside a heating chamber that accommodates a heat-target object, and controller (200) that sets a shooting condition for shooting the image of an interior of the heating chamber and carries out an image recognition to the image. Controller (200) analyzes the image of the interior of the heating chamber, thereby recognizing a state inside the heating chamber, and then changes the shooting condition in response to the state inside the heating chamber for shooting the image. The structure discussed above allows this heating cooker (100*a*), which carries out the image recognition to
(Continued)

the image of the interior of the heating chamber, to achieve a greater accuracy in the image recognition.

9 Claims, 16 Drawing Sheets

(58) Field of Classification Search
USPC ..... 219/720, 702, 705, 707, 709, 710, 711, 219/714, 745, 749, 679
See application file for complete search history.

(56) References Cited

FOREIGN PATENT DOCUMENTS

| | | |
|---|---|---|
| JP | 2005-197996 | 7/2005 |
| JP | 2013-098879 | 5/2013 |
| JP | 2014-077581 | 5/2014 |
| WO | 2014/086486 | 6/2014 |

OTHER PUBLICATIONS

International Search Report of PCT application No. PCT/JP2016/004918 dated Dec. 20, 2016.

* cited by examiner

FIG. 5

501

| ID | Item | State | Set value |
|---|---|---|---|
| SC01 | Location | Fixed | — |
| SC02 | Direction | Fixed | — |
| SC03 | Iris ( Focus) | Fixed | — |
| SC04 | Sharpness | ON | 0x01 |
| SC05 | Noise reduction | ON | 0x01 |
| SC06 | Contrast | Regular | 0x00 |
| SC07 | Gain | Regular | 0x00 |
| ⋮ | ⋮ | ⋮ | ⋮ |

FIG. 6

601

| No. | Item | State | Value |
|---|---|---|---|
| SC04-01 | Sharpness | OFF | 0x00 |
| SC04-02 | | ON | 0x01 |

FIG. 7

701

| No. | Item | State | Value |
|---|---|---|---|
| SC06-01 | Contrast | Increase (greatly) | 0x20 |
| SC06-02 | | Increase (moderately) | 0x10 |
| SC06-03 | | Regular | 0x00 |
| SC06-04 | | Lower (moderately) | 0x01 |
| SC06-05 | | Lower (greatly) | 0x02 |

FIG. 8

801

| ID | Item | State | Set value |
|---|---|---|---|
| SL01 | Location | Fixed | — |
| SL02 | Direction | Fixed | — |
| SL03 | Brightness (Lux) | 200 | 0x00C8 |
| SL04 | Color | White | 0x00 |
| SL05 | Number of lightings | 1 | 0x01 |
| ⋮ | ⋮ | ⋮ | ⋮ |

FIG. 9

901

| No. | Item | State | Value |
|---|---|---|---|
| SL03-01 | Brightness (Lux) | 0 | 0x0000 |
| SL03-02 | | 50 | 0x0032 |
| SL03-03 | | 100 | 0x0064 |
| SL03-04 | | 200 | 0x00C8 |
| SL03-05 | | 500 | 0x01F4 |
| SL03-06 | | 1000 | 0x03E8 |

FIG. 13

1301

| ID | Lighting 105a | Lighting 105b | Lighting 105c | Lighting 105d |
|---|---|---|---|---|
| SL05-01 | ON | ON | ON | ON |
| SL05-02 | ON | ON | ON | OFF |
| SL05-03 | ON | ON | OFF | ON |
| SL05-04 | ON | OFF | ON | ON |
| SL05-05 | OFF | ON | ON | ON |
| SL05-06 | ON | ON | OFF | OFF |
| : | : | : | : | : |
| SL05-16 | OFF | OFF | OFF | OFF |

FIG. 14

1401

| ID | Lighting 105a | Lighting 105b | Lighting 105c | Lighting 105d |
|---|---|---|---|---|
| SL0501-SL030001 | 50 | 50 | 50 | 50 |
| SL0501-SL030002 | 50 | 50 | 50 | 100 |
| SL0501-SL030003 | 50 | 50 | 50 | 300 |
| SL0501-SL030004 | 50 | 50 | 50 | 500 |
| SL0501-SL030005 | 50 | 50 | 50 | 1000 |
| SL0501-SL030006 | 50 | 50 | 100 | 50 |
| : | : | : | : | : |
| SL0501-SL030625 | 1000 | 1000 | 1000 | 1000 |

FIG. 20

2001

| Division | Lighting location | Brightness (Lux) |
|---|---|---|
| A | SL05-02 | 500 |
| B | SL05-06 | 400 |
| C | SL05-03 | 500 |
| D | SL05-09 | 400 |
| E | SL05-01 | 400 |
| F | SL05-08 | 400 |
| G | SL05-04 | 500 |
| H | SL05-07 | 400 |
| I | SL05-05 | 500 |

HEATING COOKER, METHOD FOR CONTROLLING HEATING COOKER, AND HEATING COOKING SYSTEM

This application is a 371 application of PCT/JP2016/004918 having an international filing date of Nov. 18, 2016, which claims priority to JP2015-231284 filed Nov. 27, 2015, the entire content of each of which is incorporated herein by reference.

TECHNICAL FIELD

The present disclosure relates to a heating cooker that carries out heat control based on a result of an image recognition, a method for controlling the heating cooker, and a heating cooking system.

BACKGROUND ART

A microwave oven, an example of the heating cooker, usually needs an input of a heating time by a user before starting the cooking.

A large number of techniques has been developed for automatically setting a heating time. For instance, patent literature 1 discloses a technique that analyzes an image of a heat-target object shot before cooking, thereby selecting a cooking method.

CITATION LIST

Patent Literature

Patent Literature 1: Japanese Utility Model No. 3036671

SUMMARY OF THE INVENTION

A conventional technique has a drawback such as a character recognition cannot be done with respect to a shot image depending on a state in a heating chamber (e.g. the inside of the heating chamber is gloomy due to poor lighting).

The present disclosure addresses the foregoing problem and shows one aspect of a heating cooker that is formed of a heating chamber accommodating a heat target object, an imaging section for shooting an image of an interior of the heating chamber, and a controller for setting a shooting condition for shooting the image of the interior of the heating chamber before carrying out an image recognition to the image. This controller analyzes the image of the interior of the heating chamber for recognizing a state inside the heating chamber before changing the shooting condition in response to the state inside the heating chamber.

The foregoing one aspect of the heating cooker that carries out the image recognition with respect to the image of the interior of the heating chamber allows increasing an accuracy in the image recognition.

BRIEF DESCRIPTION OF DRAWINGS

FIG. 5 shows a table listing setting items for a shooting section.

FIG. 6 shows set values about 'sharpness' which is one of the setting items.

FIG. 7 shows set values about 'contrast' which is one of the setting items.

FIG. 8 shows a table listing setting items for a lighting device.

FIG. 9 shows set values about 'brightness' which is one of the setting items about the lighting device.

FIG. 13 shows a table listing ON/OFF patterns of four lighting devices equipped in the heating cooker.

FIG. 14 shows a table listing brightness patterns of all the lighting devices when all of them are turned on.

FIG. 16A shows a differential image shot, when the item of 'sharpness' stays ON.

FIG. 20 shows a table listing locations of the lighting devices and their brightness for each one of the divisions.

DESCRIPTION OF EMBODIMENTS

Figure 1:
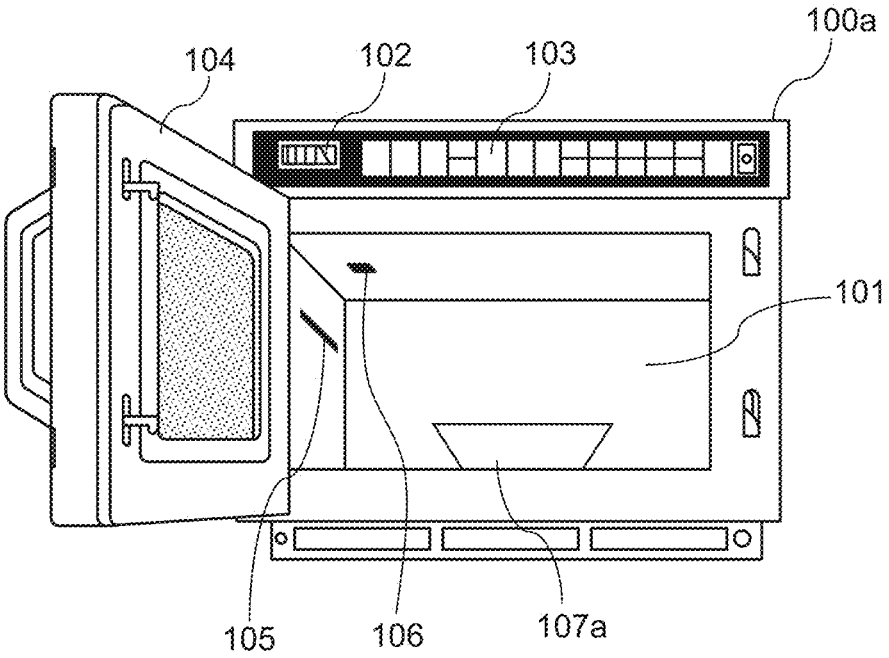
FIG. 1 is a perspective view of a heating cooker in accordance with a first embodiment of the present disclosure.

A first aspect of the heating cooker of the present disclosure shows that the heating cooker includes a heating chamber for accommodating a heat target object, a shooting section for shooting an image of an interior of the heating chamber, and a controller for setting a shooting condition in order to shoot the image of the interior of the heating chamber and then carrying out an image recognition with respect to the image. The controller analyzes the image of the interior of the heating chamber for recognizing the state inside the heating chamber, and then changes the shooting condition in response to the state inside the heating chamber before shooting.

According to this first aspect, the heating cooker, which can carry out the image recognition with respect to the image of the interior of the heating chamber, allows increasing an accuracy in the image recognition.

A second aspect of the heating cooker of the present disclosure shows that the heating cooker described in the first aspect further includes a lighting device that carries out a lighting to the interior of the heating chamber. The shooting condition contains a setting for the shooting section during the shooting and a setting for the lighting device during the lighting. According to this second aspect, the heating cooker, which can carry out the image recognition with respect to the image of the interior of the heating chamber, allows increasing an accuracy in the image recognition.

A third aspect of the heating cooker of the present disclosure shows that the controller of the heating cooker in the first aspect specifies a target region in the image of the interior of the heating chamber for the image recognition, and carries out the image recognition to the target region in the image shot again after the shooting condition is changed.

According to this third aspect, the heating cooker, which can carry out the image recognition with respect to the image of the interior of the heating chamber, allows increasing an accuracy in the image recognition.

A fourth aspect of the heating cooker of the present disclosure focuses on the shooting condition in which a sharpness of the image is changed. To be more specific, the controller sets the sharpness of the image to a higher level before shooting the image for the image recognition than the sharpness of the image shot for specifying the target region. According to this fourth aspect, the heating cooker, which can carry out the image recognition with respect to the image of the interior of the heating chamber, allows increasing an accuracy in the image recognition.

A fifth aspect of the heating cooker of the present disclosure shows that the controller of the heating cooker in the first aspect changes the shooting condition repeatedly for shooting the image again until the image recognition fails a given number of times.

According to this fifth aspect, the heating cooker, which can carry out the image recognition with respect to the image of the interior of the heating chamber, allows increasing an accuracy in the image recognition.

A sixth aspect of the heating cooker of the present disclosure shows that a character recognition and an object recognition are included in the first aspect. The controller sets the shooting condition differently to shoot the image for the object recognition from the shooting condition for the character recognition.

According to this sixth aspect, the heating cooker, which can carry out the image recognition with respect to the image of the interior of the heating chamber, allows increasing an accuracy in the image recognition.

A seventh aspect of the heating cooker of the present disclosure focuses on a control method. The method includes the following steps:

analyzing an image inside a heating chamber that accommodates a heat target object for recognizing a state inside the heating chamber;

changing a shooting condition for shooting the image in response to the state inside the heating chamber; and carrying out an image recognition to the image shot based on the shooting condition changed.

According to this seventh aspect, the heating cooker, which can carry out the image recognition with respect to the image of an interior of the heating chamber, allows increasing an accuracy in the image recognition.

An eighth aspect of the heating cooker of the present disclosure focuses on the control method. The steps in the seventh aspect further includes the step of specifying a target region in the image of the interior of the heating chamber that accommodates the heat target object for the image recognition. In the step of carrying out the image recognition, the image recognition is carried out to the target region in the image shot based on the shooting condition changed.

According to this eighth aspect, the heating cooker, which can carry out the image recognition with respect to the image of the interior of the heating chamber, allows increasing an accuracy in the image recognition.

A ninth aspect of the heating cooker of the present disclosure focuses on the control method in the seventh aspect. In the step of changing the shooting condition, which is changed repeatedly until the image recognition fails a given number of times.

According to this ninth aspect, the heating cooker, which can perform the image recognition with respect to the image of the interior of the heating chamber, allows increasing an accuracy of the image recognition.

A tenth aspect of the heating cooker of the present disclosure focuses on the control method. The image recognition in the seventh embodiment includes a character recognition and an object recognition. In the step of changing the shooting condition, a shooting condition for shooting an image for the object recognition is set differently from that for shooting the image for the character recognition.

According to this tenth aspect, the heating cooker, which can carry out the image recognition with respect to the image of the interior of the heating chamber, allows increasing an accuracy in the image recognition.

An eleventh aspect of the heating cooker of the present invention shows a heating cooking system that includes a heating cooker and an information processing device. The heating cooker includes a heating chamber for accommodating a heat target object, a shooting section for shooting an image of an interior of the heating chamber, a controller for setting a shooting condition in order to shoot the image of the interior of the heating chamber and then carrying out an image recognition with respect to the image, and a communicator for communicating the image shot by the shooting section and the shooting condition set by the controller. The information processing section includes a communication section that communicates the image and the shooting condition, and a control section that analyzes the image received by the communication section, thereby recognizing a state inside the heating chamber, setting the shooting condition in response to the state inside the heating chamber, and transmitting the set shooting condition from the communication section.

According to this eleventh aspect, the heating cooker, which can carry out the image recognition with respect to the image of the interior of the heating chamber, allows increasing an accuracy in the image recognition.

The exemplary embodiments of the present disclosure are demonstrated hereinafter with reference to the accompanying drawings.

First Exemplary Embodiment

FIG. 1 is a perspective view of heating cooker 100*a* in accordance with the first embodiment of the present disclosure.

As FIG. 1 shows, heating cooker 100*a* includes heating chamber 101 for accommodating heat target object 107*a* such as a food. Door 104 is provided to heating chamber 101 for covering a front opening of room 101. Heating chamber 101 also includes display section 102 and menu selecting section 103 provided above the front opening.

Display section 102 displays information (e.g. heating time) related to the operation of heating cooker 100*a*. Menu selecting section 103 has multiple buttons, such as a start button, to be used by users to input details of setting (e.g. heating time). Menu selecting section 103 can be formed of a touch panel.

Lighting 105 is placed deep in an opening provided on a lateral wall of heating chamber 101 for lighting an interior of heating chamber 101. Camera 106 is placed deep in an opening provided on a ceiling of heating chamber 101 for shooting inside heating chamber 101.

A control circuit (not shown) controls lighting 105 and camera 106, thereby allowing heating cooker 100*a* to obtain information such as a heating degree of heat target object 107*a* in a form of images.

As FIG. 1 shows, lighting 105 is provided on the lateral wall of heating chamber 101. As long as lighting 105 can illuminate all over the heating chamber 101, it can be provided to another place (e.g. ceiling of heating chamber 101). Lighting 105 can include multiple lighting devices.

Camera 106 is disposed closely to the left end of the ceiling of heating chamber 101; nevertheless, as long as camera 106 can shoot an entire inside of heating chamber 101, it can be disposed at another place (e.g. on the lateral wall of heating chamber 101). Camera 106 placed at the center of the ceiling can shoot heat target object 107*a* from the right above. Camera 106 can include multiple shooting sections.

Figure 2:
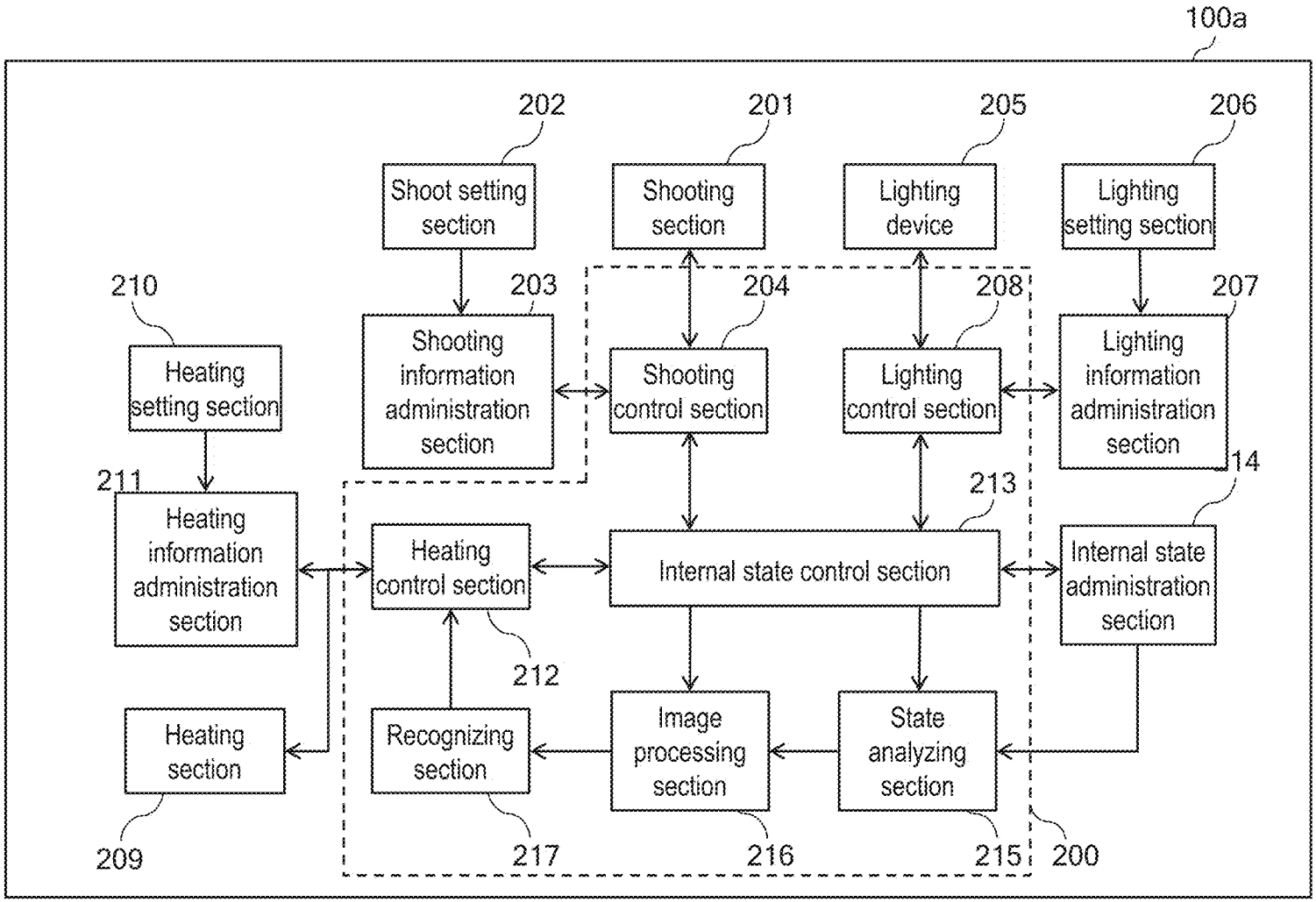
FIG. 2 is a block diagram showing a structure of the heating cooker in accordance with the first embodiment.

FIG. 2 is a block diagram illustrating a structure of heating cooker 100*a* in accordance with the first embodiment.

As FIG. 2 shows, heating cooker 100*a* formed of controller 200, shooting section 201, shoot setting section 202, shoot information administration section 203, lighting device 205, lighting setting section 206, lighting information administration section 207, heating section 209, heating setting section 210, heating information administration section 211, and internal state administration section 214.

Controller 200 includes shoot control section 204, lighting control section 208, heating control section 212, internal state control section 213, state analyzing section 215, image processing section 216, and recognizing section 217.

In this first embodiment, controller 200 is formed of a microcomputer. The present disclosure is not limited to this instance; nevertheless, use of a programmable microprocessor allows changing a content to be processed with ease, and increasing a degree of freedom in design.

In order to speed up the processing speed, the structural elements of controller 200 can be formed of a logic circuit. These structural elements can be formed of a single element or multiple elements physically. In the case of using the multiple elements, each of the structural elements can be corresponded to each one of the multiple elements. In this case, it is presumable that each of these multiple elements works as each one of the structural elements.

Shooting section 201 is equivalent to camera 106 shown in FIG. 1, and includes imaging elements such as CMOS image sensor, CCD image sensor, and also includes optical elements such as lenses. Shooting section 201 works as a device for shooting inside heating chamber 101.

Shoot setting section 202 is included in menu selecting section 103 and is used for setting a shoot. Shoot information administration section 203 includes nonvolatile memory for storing the content set by shoot setting section 202.

Shoot control section 204 controls shooting section 201 in response to the set content stored in shoot information administration section 203, which stores the images shot by shooting section 201.

Lighting device 205 is equivalent to lighting 105 shown in FIG. 1 and works as a light emitting element for lighting inside heating chamber 101.

Lighting setting section 206 is included in menu selecting section 103 and is used for setting the lighting. Lighting information administration section 207 includes a nonvolatile memory for storing the content set by lighting setting section 206. Lighting control section 208 controls lighting device 205 in response to the set content stored in lighting information administration section 207.

Heating section 209 is formed of a magnetron and others for heating the heat target object 107*a*. Heating setting section 210 is included in menu selecting section 103 and is used for setting details of the heating.

Heating information administration section 211 includes a nonvolatile memory for storing the details set by heating setting section 210. Heating control section 212 controls heating section 209 in response to the set details stored in heating information administration section 211.

Internal state control section 213 controls shoot control section 204 and lighting control section 208 in response to an internal state such as whether or not door 104 is open or whether or not heating section 209 is in operation, and transmits necessary information to heating control section 212.

Internal state administration section 214 includes a nonvolatile memory for storing the information about a state inside heating chamber 101 (hereinafter simply referred to 'internal state'), and transmits the information about the internal state in response to a change in the internal state to internal state control section 213. The internal state implies the information such as whether or not heat target object is present in heating chamber 101 and whether or not door 104 is closed.

State analyzing section 215 analyzes the internal state based on the information supplied from internal state administration section 214 before determining whether or not the image recognition can be implemented. The state, in which the image recognition can be implemented, refers to the presence of heat target object 107*a* in heating chamber 101 and door 104 being closed. The image recognition includes the character recognition, barcode recognition, and object recognition.

In the case of the image recognition being implementable in the internal state, image processing section 216 analyzes the image shot by shooting section 201 for specifying the region where characters regarding heat information are possibly included. Hereinafter this specified region is referred to as a target region to be used for the image recognition such as character recognition.

Recognizing section 217 carries out the image recognition to the target region. When recognizing section 217 normally carries out the image recognition, heating control section 212 controls heating section 209 in response to the information obtained through the image recognition.

When heat target object 107*a*, for example a lunch box (refer to FIG. 3), is placed in heating cooker 100*a* structured as discussed above, the food in the lunch box is selected as target region 301; nevertheless, the entire lunch box can be selected as target region 302 depending on a method of the image recognition.

Figure 3:
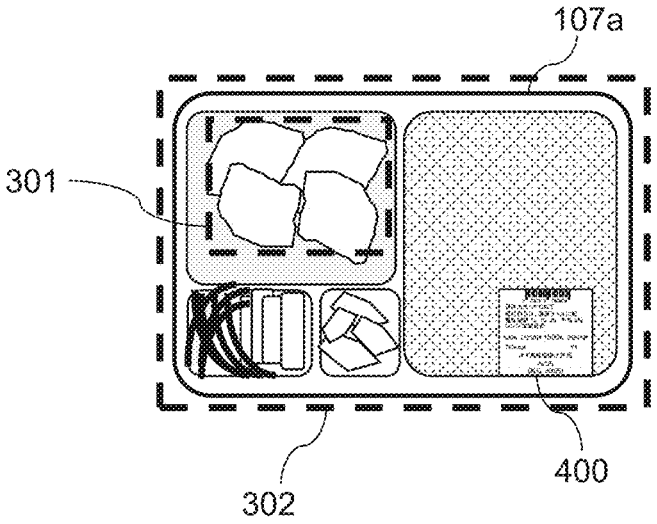
FIG. 3 shows contents of a lunch box, which is an example of a heat target object.
Figure 4:
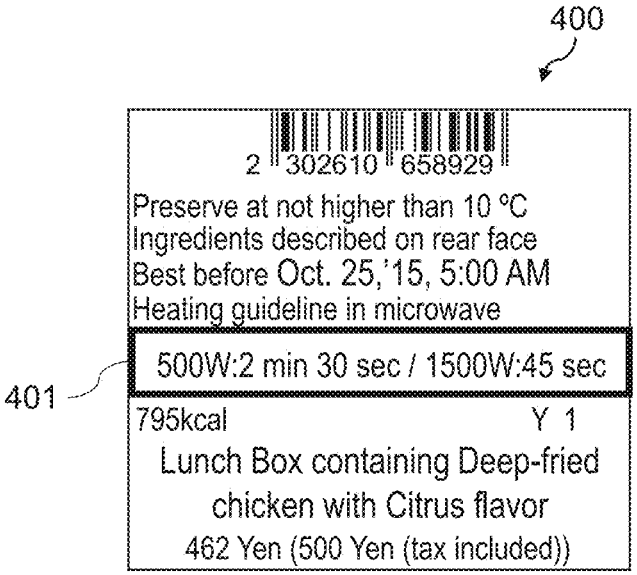
FIG. 4 shows an example of a food label stuck on the lunch box for describing details about the contents.

FIG. 4 shows food label 400 stuck to the lunch box shown in FIG. 3. As FIG. 4 shows, the characters and barcodes to be recognized are printed on food label 400. Target region 401 is specified in food label 400, and the character recognition or the barcoded recognition is implemented to target region 401 for specifying a heating time.

FIG. 5 is set-item table 501 listing items to be set for shooting section 201 and controlled by shoot information administration section 203 (refer to FIG. 2). As table 501 shows, the set-items include items for controlling hardware and items for controlling software.

The items for controlling hardware include a location and a focus of shooting section 201 (refer to FIG. 2). The items for controlling software include image-processing related items such as sharpness, noise reduction, contrast, and gain.

FIG. 6 shows set-value table 601 about item 'sharpness' listed in set-items table 501.

As FIG. 6 shows, item 'sharpness' can be set to either one of '0x00' corresponding to OFF and '0x01' corresponding to ON.

FIG. 7 shows set-value table 701 about item 'contrast' listed in set-items table 501.

As FIG. 7 shows, item 'contrast' can be set to one of these five states, viz. 'increase greatly', 'increase moderately', 'regular', 'lower moderately', and 'lower greatly'. These five states are represented by '0x20', '0x10', '0x00', '0x01', and '0x02' respectively.

In the instance discussed above, set-value table 601 lists two candidates about item 'sharpness', nevertheless, table 601 can list four states (e.g. maximum, medium, minimum, and OFF). Item 'contrast' will not be limited to the above instance.

Tables 601 and 701 are controlled by shoot information administration section 203 (refer to FIG. 2) similar to table 501. To be more specific, as FIG. 2 shows, administration section 203 administers these tables as information to be needed when shooting section 201 shoots an image, or when image processing section 216 and recognizing section 217 carry out an image processing.

As FIG. 5 shows, in set-item table 501, the items necessary for controlling hardware are set to fixed values. The items necessary for controlling software are set in the following manner: 'sharpness', 'noise reduction''contrast', and 'gain' are set to ON (0x01), ON (0x00), regular (0x00), and regular (0x00) respectively.

FIG. 8 shows set-item table 801 listing items to be set for lighting device 205 and these items are administered by lighting information administration section 207 (refer to FIG. 2).

As FIG. 8 shows, table 801 lists the items necessary for controlling hardware and the items necessary for controlling software. The items necessary for controlling hardware includes a physical location, a direction, and others of lighting device 205 (refer to FIG. 2). The items necessary for controlling software includes a brightness, a color, and others.

FIG. 9 shows set-value table 901 about item 'brightness' listed in set-item table 801.

Item 'brightness (Lux)' is set to any one of the following six states, viz. '0', '50', '100', '200', '500', and '1000'. These six states correspond to '0x0000', '0x0032', '0x0064', '0x0008', '0x01F4', '0x03E8' respectively.

In the instance discussed above, set-value table 901 lists six states about item 'brightness', nevertheless, the number of the states can be other than six. Set-value table 901 not necessarily includes predetermined states, instead, a user can input any state or value in table 901.

Set-value table 901 is administered by lighting information administration section 207 (refer to FIG. 2) as set-item table 801 is done. To be more specific, as FIG. 2 shows, lighting information administration section 207 administers these tables as the information needed when lighting device 205 lights inside heating chamber 101, or when image processing section 216 and recognizing section 217 carry out the image recognition.

As FIG. 8 shows, in set-item table 801, the items necessary for controlling hardware are set to fixed values. The items necessary for controlling software, such as 'brightness (Lux) and 'color' are set to 200 Lux (0x0008) and white (0x00) respectively.

Figure 10:
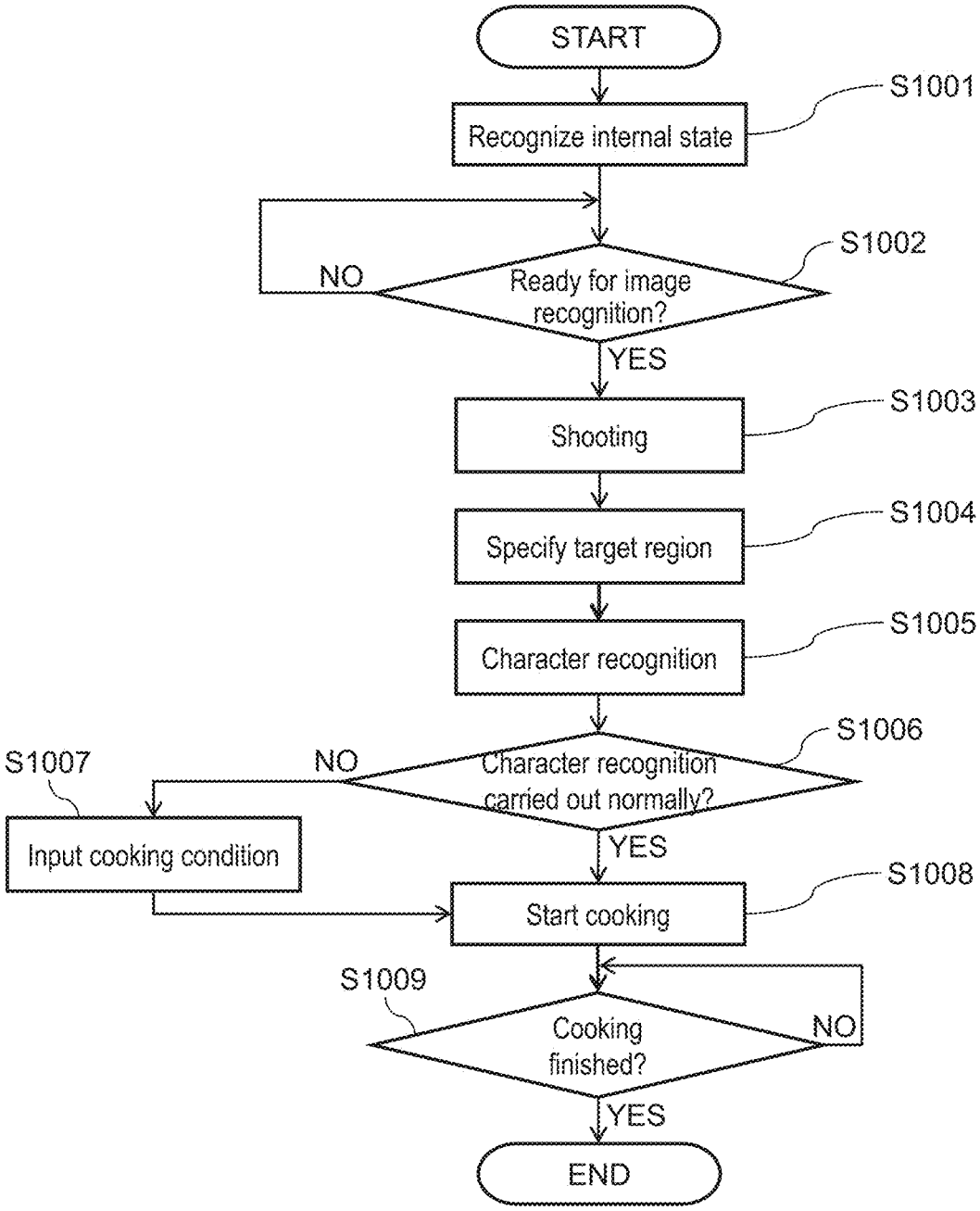
FIG. 10 is a flowchart of an operation of the heating cooker in accordance with the first embodiment.

FIG. 10 is a flowchart illustrating the operation of heating cooker 100*a*. In the processes shown in FIG. 10, food label 400 (refer to FIG. 3 and FIG. 4) in the shot image is specified as a target region for the character recognition.

As FIG. 10 shows, in step S1001, state analyzing section 215 recognizes the internal state. The image inside heating chamber 101*a* is shot in order to recognize whether or not heat target object 107*a* is present in heating chamber 101, and state analyzing section 215 analyzes the shot image.

In step S1002, when state analyzing section 215 determines that the internal state is not yet ready for the image recognition, then the process returns to step S1001. On the other hand, when state analyzing section 215 determines that the internal state is ready for the image recognition, the process moves to step S1003, where shoot control section 204 changes the shooting condition if necessary, and shooting section 201 shoots the image inside heating chamber 101.

In step S1004, image processing section 216 specifies the target region in the shot image. In step S1005, recognizing section 217 carries out the character recognition to the specified target region.

In step S1006, when recognizing section 217 determines that either one of the target region specification or the character recognition is not carried out normally, then the process moves to step S1007, where internal state control section 213 urges the user to input a cooking condition manually. When state analyzing section 215 recognizes the input via menu selecting section 103, the cooking condition is changed in response to the input.

In step S1006, when recognizing section 217 determines that the character recognition is carried out normally, the cooking condition in response to a result of the determination is input automatically.

When an input of the cooking condition is finished in step S1006 or in step S1007, the process moves to step S1008, where internal state control section 213 urges the user to start cooking by turning on a start button or with another signal. Recognition of pressing the start button by state analyzing section 215 prompts heating control section 212 to control heating section 209 such that heating section 209 starts cooking following the set cooking condition.

In step S1009, internal state control section 213 carries on recognizing the internal state until heat-target object 107 becomes a given state. When heat target object 107*a* becomes the given state, heating control section 212 prompts heating section 209 to stop cooking.

In the instance discussed above, the character recognition is carried out to food label 400. This character recognition can be replaced with the object recognition to heat target object 107*a*, a food recognition in parts to heat target object 107*a*, or the barcode recognition to food label 400.

A heat time and a heat wattage are the typical target information for the character recognition; nevertheless, the target information for the character recognition can be characters printed on food label 400, such as an expiry data, type of content in lunch box, product name, calories, and price.

In this first embodiment, the character recognition starts upon closing door 104; nevertheless, the character recognition can start upon opening door 104 or upon pressing the start button.

In this first embodiment, the set-item table can be changed in order to specify the target region and for the image recognition. Heating cooker 100*a* can be structured such that display section 102 displays the image inside heating chamber 101 when the inside of the heating chamber 101 is shot.

Hereinafter, the set items for shooting section 201 (set-item table 501) and the set items for lighting device 205 (set-item table 801) are collectively referred to as shooting condition.

Second Exemplary Embodiment

Figure 11:
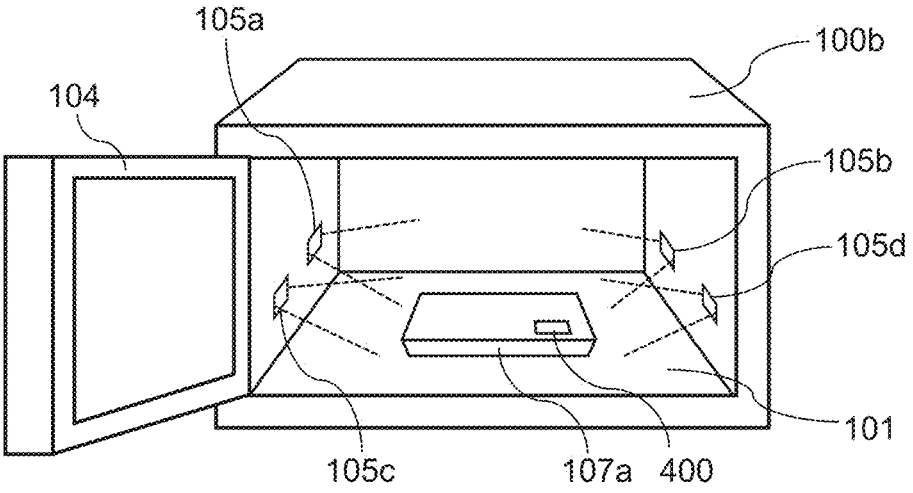
FIG. 11 is a perspective view of a heating cooker in accordance with a second embodiment of the present disclosure.
Figure 12:
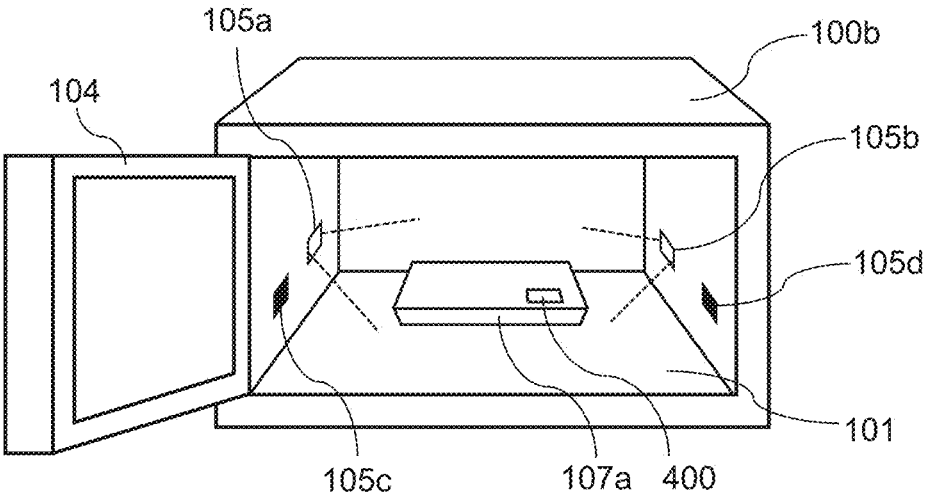
FIG. 12 is a perspective view of a heating cooker in accordance with the second embodiment of the present disclosure.

Heating cooker 100*b* in accordance with the second embodiment is demonstrated hereinafter. FIG. 11 and FIG. 12 are perspective views of heating cooker 100*b*. FIG. 11 shows heat target object 107*a* placed at the center inside heating chamber 101. FIG. 12 shows heat target object 107*a* placed near to a back wall of heating chamber 101.

Heating cooker 100*b* has almost the same structure (refer to FIG. 2-FIG. 10) as heating cooker 100*a* described in the first embodiment; nevertheless, heating cooker 100*b* differs from cooker 100*a* in the number and location of lightings and in a method for controlling the lighting. In this second embodiment, the descriptions of the sections common to those in the first embodiment are omitted.

As FIG. 11 and FIG. 12 show, heating cooker 100*b* includes four lightings. To be more specific, lightings 105*a* and 105*c* are disposed on the left-side wall, lightings 105*b* and 105*d* are disposed on the right-side wall inside heating chamber 101. Lightings 105*a*, 105*b* are placed near to the back wall, and lightings 105*c*, 105*d* are placed away from the back wall of heating chamber 101.

The method for controlling the lightings in accordance with this second embodiment basically follows the same processes shown in FIG. 10. To be more specific, in step S1001, all the lightings are lit, and then the image inside heating chamber is shot. Heat target object 107*a* shown in FIG. 11 is shot approx. at the center in the image, and object 107*a* in FIG. 12 is shot at the left end in the image. State analyzing section 215 analyzes the image for recognizing the location of heat target object 107*a*.

In step S1003, in the case of the state shown in FIG. 11, all the lightings are kept lighting. In the case of the state shown in FIG. 12, lightings 105*a* and 105*b* are kept lighting, while lightings 105*c* and 105*d* are put out. After the adjustment of the lightings, the image is shot.

FIG. 13 shows set-value table 1301 listing ON/OFF patterns of each lighting in the case of using four lightings. As FIG. 13 shows, since the four lightings can be in ON state or OFF state, table 1301 lists 16 patterns.

FIG. 14 shows set-value table 1401 listing patterns of brightness (Lux) of each one of the lightings in the case where all of the four lightings are in ON state. Since each of the four lightings has 5 steps in the brightness (refer to FIG. 9), table 1401 lists 625 patterns as shown in FIG. 14.

This second embodiment proves that the control of the lighting in response to the location of heat-target object 107*a* will prevent halation. As a result, an accuracy in the image recognition can be improved.

Third Exemplary Embodiment

Heating cooker 100*c* in accordance with the third embodiment is demonstrated hereinafter.

Heating cooker 100*c* has a similar structure to that (refer to FIG. 1-FIG. 10) of heating cooker 100*a* in accordance with the first embodiment. The description about the structure thus omitted here.

In this third embodiment, food label 400 (refer to FIG. 3 and FIG. 4) is specified from the shot image as a target region for the character recognition. This is the same process that is done in the first embodiment.

Figure 15:
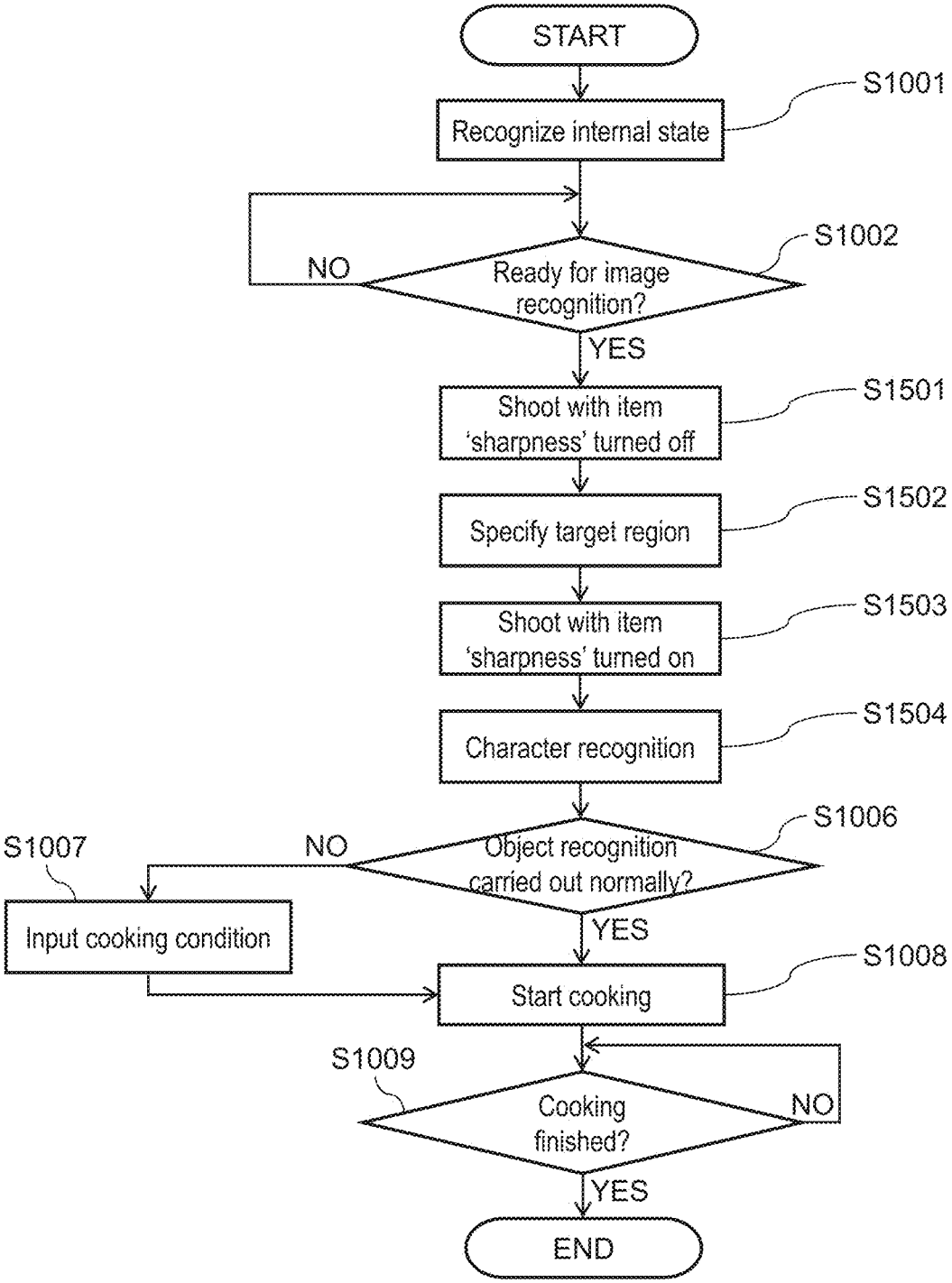
FIG. 15 is a flowchart of an operation of a heating cooker in accordance with a third embodiment of the present disclosure.

The operation of heating cooker 100*c* in accordance with the third embodiment is demonstrated with reference to FIG. 15 which is a flowchart illustrating the operation of heating cooker 100*c*.

This flowchart has the same steps as those shown in FIG. 10 except steps S1501-S1504 that replace steps S1003-S1005 in the flowchart shown in FIG. 10. Hereinafter steps S1501-S1504 are detailed.

In step S1002, state analyzing section 215 determines the internal state is ready for the image recognition, then the process moves to step S1501, where shoot control section 204 puts the item 'sharpness' listed in set-item table 501 in OFF state, and then shoots the image inside heating chamber 101.

In step S1502, image processing section 216 specifies a target region, which possibly contains the characters related to heating information, from the shot image.

Figure 16A:
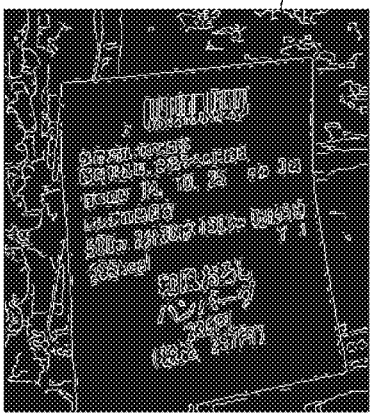
Figure 16B:
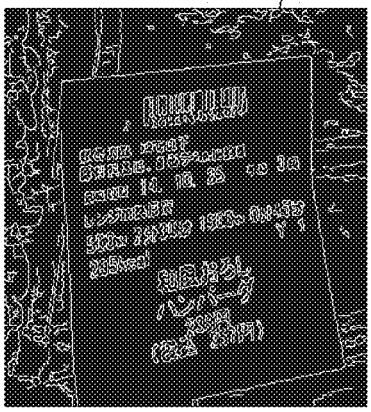
FIG. 16B shows a differential image shot when the item of 'sharpness' stays OFF.

FIG. 16A shows differential image 1601 with respect to the image shot with item 'sharpness' staying in ON state. FIG. 16B shows differential image 1602 with respect to the image shot with item 'sharpness' staying in OFF state.

As FIG. 16A and FIG. 16B show, differential image 1602 shows clearer outlines of the characters and clearer lines than those in differential image 1601. In other words, item 'sharpness' staying in OFF state allows distinguishing edges from others with more ease. As a result, the target region can be specified with a better accuracy.

In step S1503, shoot control section 204 puts item 'sharpness' in ON state and then shoots the image inside heating chamber 101 again.

The image shot in step S1503 undergoes the character recognition in step S1005 with respect to the target region specified in step S1502. Use of the image shot with item 'sharpness' staying in ON state will achieve the character recognition with a higher accuracy.

In this third embodiment, item 'sharpness' is put in OFF state in order to specify the target region, and item 'sharpness' is put in ON state in order to carry out the character recognition; nevertheless the third embodiment is not limited to this instance.

Other software processes, such as noise reduction, contrast, and white balance, can be used for specifying the target region and carrying out the character recognition. Multiple software processes can be combined. At least one hardware process can be added to the software process.

A change in the setting can be omitted in step S1501 or step S1503 to shorten a process time.

Fourth Exemplary Embodiment

Heating cooker 100*d* in accordance with the fourth embodiment is demonstrated hereinafter.

Heating cooker 100*d* has a structure similar to that of heating cooker 100*a* in accordance with the first embodiment (refer to FIG. 1-FIG. 10), so that the description about the structure is omitted here.

In this fourth embodiment, a target region for the character recognition is extracted from food label 400 (refer to FIG. 3 and FIG. 4).

Figure 17:
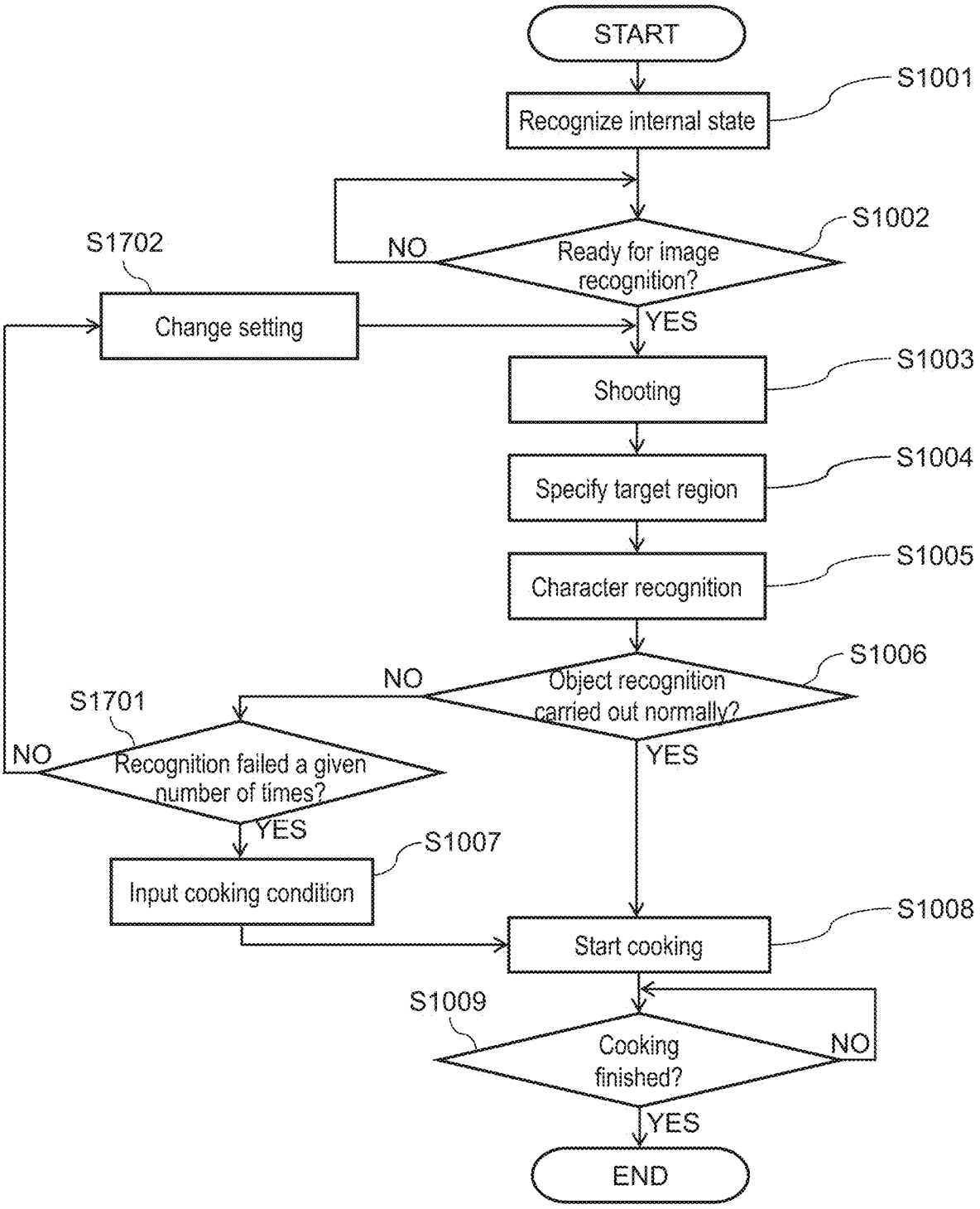
FIG. 17 is a flowchart of image recognition carried out in a fourth embodiment of the present disclosure.

FIG. 17 is a flowchart illustrating an operation of heating cooker 100*d*. In this flowchart, steps S1701 and S1702 are added to the steps in FIG. 10. Steps S1701 and S1702 are detailed hereinafter.

In step S1006, when recognizing section 217 determines that either one of the target region specification or the character recognition is not carried out normally, the process moves on to step S1701, where recognizing section 217 determines whether or not the character recognition fails a given number of times.

Until the character recognition fails the given number of times, internal state control section 213 changes the shooting condition in step S1702 in response to the causes of the failures.

In step S1003, the inside of heating chamber 101 is shot in response to the changed shooting condition. In step S1006, when recognizing section 217 determines that the character recognition fails the given number of times, the process moves on to step S1007 discussed above.

In this fourth embodiment, in step S1006, the determination by recognizing section 217 that either one of the target region specification or the character recognition is not carried out normally prompts internal state control section 213 to change the shooting condition. Nevertheless, when image processing section 216 fails in specifying the target region or when recognizing section 217 fails in the character recognition, the shooting condition can be changed every time in such occasions for a next shooting.

Figure 18A:
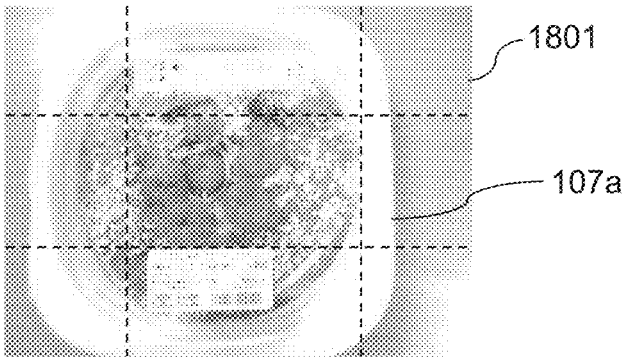
FIG. 18A shows an image to which the image recognition cannot be carried out.
Figure 18B:
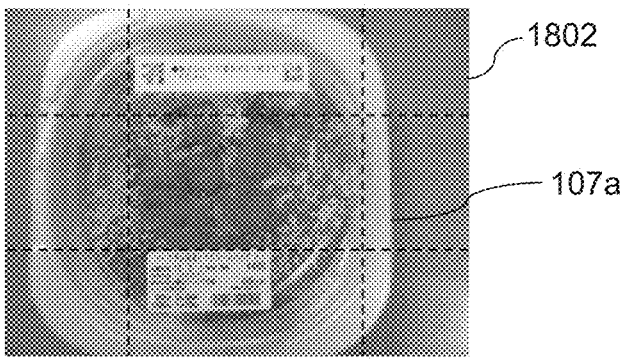
FIG. 18B shows an image to which the image recognition can be carried out.

Here is a more specific instance: FIG. 18A and FIG. 18B show images of heat target object 107*a* inside heating chamber 101.

Heat target object 107*a* is sometimes not fit into a shooting frame depending on a location of object 107*a* or a situation during the shooting, or food label 400 cannot be read well due to reflection of the lighting. Focusing, iris-in or iris-out cannot be always controlled appropriately to the overall space in heating chamber 101 depending on the locations of shooting section 201 or lighting device 205.

FIG. 18A shows an image, in which the characters printed on food label 400 is not read clearly. In this case, although the target region can be specified, it is possible that the character recognition cannot be done normally.

This fourth embodiment proposes an idea to overcome the problem discussed above, viz. state analyzing section 215 realizes a location of the target region in the image, and then changes the shooting condition in response the location.

Figure 19:
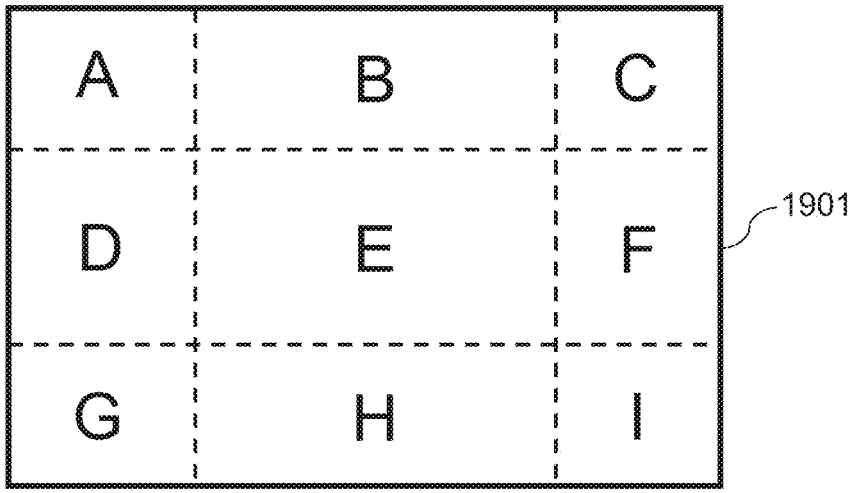
FIG. 19 shows divisions in a shot image for changing setting items.

FIG. 19 shows the divisions in each of which the shooting condition can be changed. For instance, when the target region is located in other divisions than the center division, it is possibly difficult to carry out the character recognition in the target region due to poor lighting, out of focus, or other reasons. This fourth embodiment thus allows changing the shooting condition in each of the divisions independently.

FIG. 20 shows a table in which lighting location and brightness are set for each one of the divisions to prevent halation.

In the case of the image shown in FIG. 18A, state analyzing section 215 changes the lighting location to 'SL05-07' and the brightness to 400 Lux in division H according to the table shown in FIG. 20. FIG. 18B shows an image newly shot. According to this fourth embodiment, as shown in FIG. 18B, the characters in the target region are shot clearly. As a result, the character recognition can be done more positively.

Fifth Exemplary Embodiment

Figure 21:
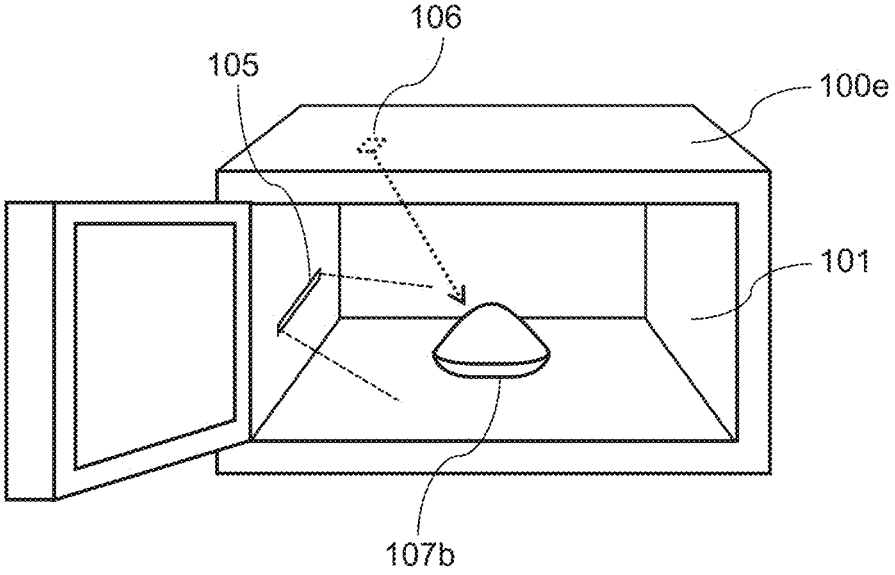
FIG. 21 is a perspective view of a heating cooker in accordance with a fifth embodiment of the present disclosure.

The heating cooker in accordance with the fifth embodiment is demonstrated hereinafter. FIG. 21 is a perspective view of heating cooker 100*e*, and shows heat target object 107*b* placed at the center of heating chamber 101. As FIG. 21 shows, food label 400 is not stuck to heat target object 107*b*. This is a different point from heat target object 107*a*.

Heating cooker 100*e* has a structure similar to that of heating cooker 100*a* (refer to FIG. 1-FIG. 10) in accordance with the first embodiment, so that the description of the structure is omitted here.

Figure 22:
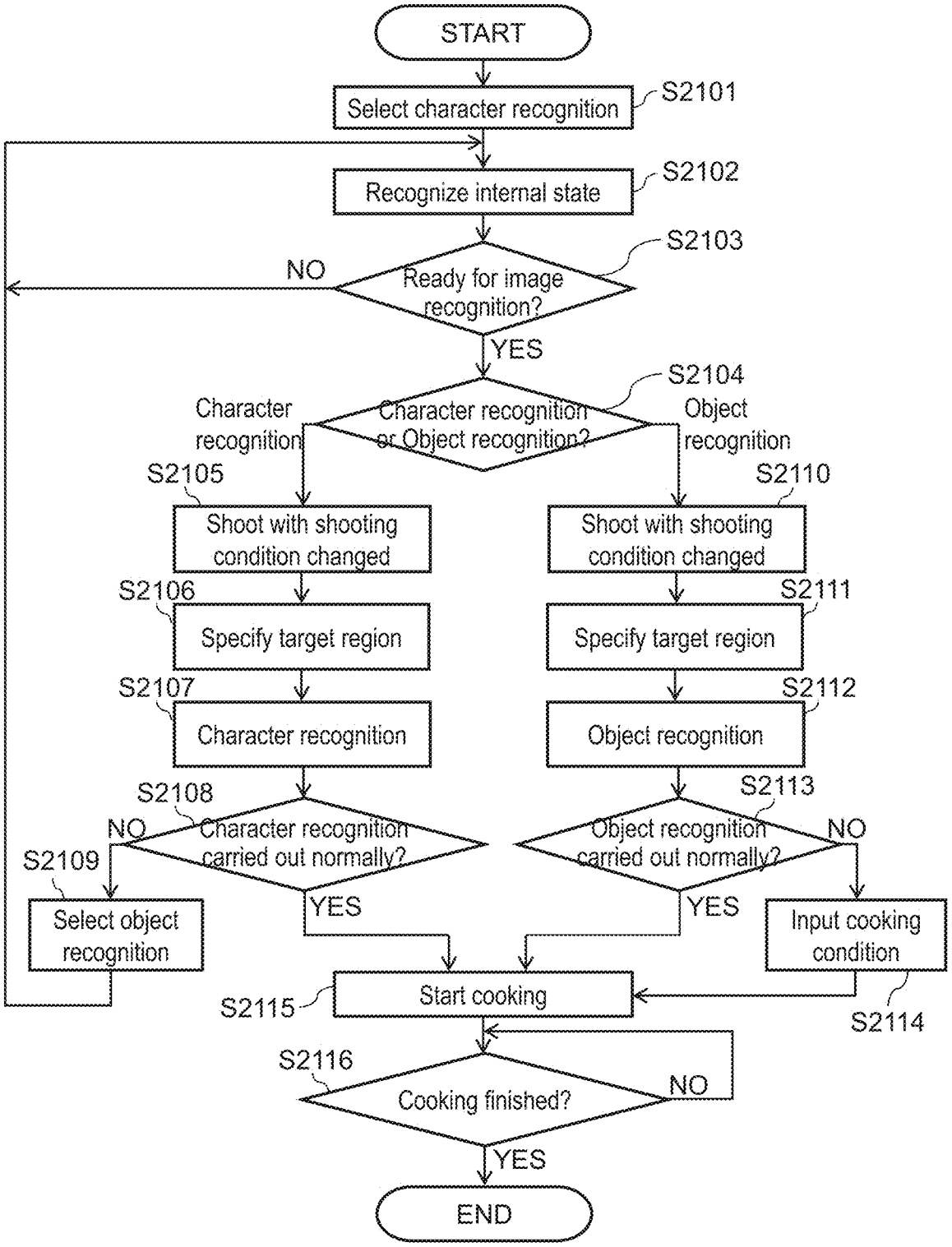
FIG. 22 is a flowchart of an operation of the heating cooker in accordance with the fifth embodiment.

FIG. 22 is a flowchart showing an operation of heating cooker 100*e*. In the flowchart shown in FIG. 22, an object recognition is carried out to heat target object 107*b*.

As FIG. 22 shows, in step S2101, internal state control section 213 selects the character recognition as a recognition mode, and internal state administration section 214 administrates the recognition mode.

In step S2102, state analyzing section 215 (refer to FIG. 2) recognizes the internal state of heating cooker 100*e*. In step S2103, if state analyzing section 215 determines that door 104 is not closed, the process returns to step S2102.

In step S2103, when state analyzing section 215 determines that door 104 is closed, state analyzing section 215 determines which one of the character recognition or the object recognition should be used in response to the recognition mode.

At the first time, since the recognition mode is set to the character recognition, internal state control section 213 changes the shooting condition to that for the character recognition in step S2105. Then shoot control section 204 prompts shooting section 201 to shoot the image inside heating chamber 101.

In step S2106, image processing section 216 specifies a target region for the object recognition. In step S2107, recognizing section 217 carries out the character recognition to the target region.

In step S2108, when recognizing section 217 determines that the character recognition is carried out normally, the cooking details in response to the result of the character recognition are input automatically. In step S2108, if recognizing section 217 determines that either one of the target region specification or the character recognition is not carried out normally, the process moves on to step S2109, where the object recognition is selected as the recognition mode. Then the process returns to step S2102.

In step S2102, state analyzing section 215 recognizes the internal state of heating cooker 100*e*. In step S2103, when state analyzing section 215 determines that door 104 is closed, state analyzing section 215 confirms the recognition mode in step S2104. Then the process moves on to step S2110.

This time, since the recognition mode is set to the object recognition, in step S2110 internal state control section 213 changes the shooting condition to that for the object recognition. Then shoot control section 204 prompts shooting section 201 to shoot the image inside heating chamber 101.

In step S2111, image processing section 216 specifies a target region for the object recognition. In step S2112, recognizing section 217 carries out the object recognition to the target region.

In step S2113, when recognizing section 217 determines that either one of the target region specification or the object recognition is not carried out normally, internal state control section 213 urges the user to input the setting manually. When state analyzing section 215 recognizes the input done through menu selecting section 103, the setting following the input is implemented.

In step S2113, when recognizing section 217 determines that the object recognition is carried out normally, the cooking details in response to the object recognition are input automatically.

When the input of the setting of the cooking details is finished in step S2113 or step S2114, the process moves on to step S2115, where internal state control section 213 urges the user to start cooking through depressing the start button or with another action. When state analyzing section 215 recognizes the press of the start button, heating control section 212 controls heating section 209 such that it starts cooking in response to the setting of the cooking details.

In step S2116, internal state control section 213 carries on recognizing the internal state until heat target object 107 becomes a given state. When heat target object 107*b* becomes the given state, heating control section 212 finishes the cooking.

As discussed above, in this fifth embodiment the settings are prepared for the shooting differently in the case of the character recognition from in the case of the object recognition, so that a more accurate image recognition can be achieved.

Sixth Exemplary Embodiment

The heating cooking system in accordance with the sixth embodiment is demonstrated hereinafter.

This sixth embodiment includes heating cooker 100*f* that has a structure similar to that of heating cooker 100*a* (refer to FIG. 1-FIG. 10) in accordance with the first embodiment.

Heating cooker 100*f* differs from heating cooker 100*a* in the presence of a communicator, and in the absence of functions of state analyzing section 215, image processing section 216, and recognizing section 217 in controller 200. The communicator connects, via a network, heating cooker 100*f* to an information processing device such as a portable terminal or an external server.

In this sixth embodiment, the information processing device implements the functions of state analyzing section 215, image processing section 216, and recognizing section 217.

The information processing device thus includes a communicating section and a control section in order to implement the foregoing functions. The communicating section of the information processing device receives the image inside heating chamber 101 from the communicator of heating cooker 100*f*. The control section of the information processing device analyzes the image received, thereby recognizing a state inside heating chamber 101, and sets the shooting condition in response to the state inside heating chamber 101. The communicating section of the information processing section transmits the set shooting condition to the communicator of heating cooker 100*f*.

The image recognition in this sixth embodiment is carried out by the external information processing device, viz. the heating cooking system is formed of heating cooker 100*f* and the information processing device.

In this heating cooking system, the information processing device can include not only the functions of state analyzing section 215, image processing section 216, and recognizing section 217, but also functions of other structural elements included in controller 200.

A display section provided to the portable terminal can display the image of the interior of the heating chamber. Here is another instance, where the display section of the portable terminal can display a shape, characters, and a barcode of an object recognized by the portable terminal or the external server. A display section provided to the heating cooker can display the shape, characters, and the barcode of the object recognized.

INDUSTRIAL APPLICABILITY

The present disclosure is useful for professional heating cookers used in convenience stores and catering traders. It is also useful for home-use heating cookers.

REFERENCE MARKS IN THE DRAWINGS

100*a*, 100*b*, 100*c*, 100*d*, 100*e*, 100*f* heating cooker
101 heating chamber
102 display section
103 menu selecting section
104 door
105, 105*a*, 105*b*, 105*c*, 105*d* lighting
106 camera
107*a*, 107*b* heat target object
200 controller
201 shooting section
202 shoot setting section
203 shoot information administration section
204 shoot control section
205 lighting device
206 lighting setting section
207 lighting information administration section
208 lighting control section
209 heating section
210 heating setting section
211 heating information administration section
212 heating control section
213 internal state control section
214 internal state administration section
215 state analyzing section
216 image processing section
217 recognizing section
301, 302, 401 target region
400 food label

The invention claimed is:

1. A heating cooker comprising:

a heating chamber configured to accommodate a heat target object;

a shooting section configured to shoot an image of an interior of the heating chamber;

a controller configured to set a shooting condition in order to shoot the image, and carry out an image recognition to the image;

wherein the controller is configured to recognize a state inside the heating chamber through analyzing the image, and changes the shooting condition in response to the state inside the heating chamber; and wherein the controller is configured to specify a target region of the image recognition in the image, and to carry out the image recognition to the target region in the image shot again based on a changed shooting condition.

2. The heating cooker according to claim 1, further comprising a lighting device configured to light the interior of the heating chamber, wherein the shooting condition includes a setting for the shooting section and a setting for the lighting device.

3. The heating cooker according to claim 1, wherein the changed shooting condition refers to a sharpness of the image, and the controller sets a sharpness of the image before shooting the image for the image recognition to a higher level than a sharpness of the image having been shot for specifying the target region.

4. The heating cooker according to claim 1, wherein the controller repeats a change in the shooting condition until the image recognition fails a given number of times, and shoots the image again.

5. The heating cooker according to claim 1, wherein the image recognition includes a character recognition and an object recognition, and wherein the controller is configured to set the shooting condition differently in order to shoot the image for the object recognition from the shooting condition used for shooting the image for the character recognition.

6. A method for controlling a heating cooker, the method comprising the steps of:

recognizing a state inside a heating chamber through analyzing an image of an interior of the heating chamber accommodating a heat target object;

changing a shooting condition for shooting the image in response to the state inside the heating chamber;

carrying out an image recognition to the image shot based on a changed shooting condition; and specifying a target region of the image recognition in the image of the interior of the heating chamber accommodating the heat target object, wherein in the step of recognizing a state inside a heating chamber, the image recognition is carried out to the target region in the image shot based on the changed shooting condition.

7. The method for controlling a heating cooker according to claim 6, wherein in the step of changing a shooting condition, the shooting condition is changed repeatedly until the image recognition fails a given number of times.

8. The method for controlling a heating cooker according to claim 6, wherein the image recognition includes a character recognition and an object recognition, and in the step of changing a shooting condition, the shooting condition is set differently in order to shoot the image for the object recognition from the shooting condition used for shooting the image for the character recognition.

9. A heating cooking system comprising a heating cooker and an information processing device, wherein the heating cooker includes a heating chamber configured to accommodate a heat target object;

a shooting section configured to shoot an image of an interior of the heating chamber;

a controller configured to set a shooting condition for shooting the image; and a communicator configured to communicate the image shot by the shooting section and the shooting condition set by the controller, wherein the information processing section includes a communicating section for communicating the image and the shooting condition, and a control section configured to recognize a state inside the heating chamber through analyzing the image received in the communicating section, then set the shooting condition in response to the state inside the heating chamber, and then transmit the set shooting condition from the communicating section, wherein the controller is configured to carry out an image recognition to the image, to specify a target region of the image recognition in the image, and to carry out the image recognition to the target region in the image shot again based on a changed shooting condition.

* * * * *